US012708978B2

(12) United States Patent
Oh et al.

(10) Patent No.: US 12,708,978 B2
(45) Date of Patent: Aug. 18, 2026

(54) ACOUSTIC CARRIER HEAD MONITORING

(71) Applicant: Applied Materials, Inc., Santa Clara, CA (US)

(72) Inventors: Jeonghoon Oh, Saratoga, CA (US); Jianshe Tang, San Jose, CA (US); Steven M. Zuniga, Soquel, CA (US); Brian J. Brown, Palo Alto, CA (US); Andrew J. Nagengast, Sunnyvale, CA (US); Derek R. Witty, Fremont, CA (US); Rushabhkumar Desai, San Jose, CA (US); Shih-Haur Shen, Sunnyvale, CA (US); Haosheng Wu, San Jose, CA (US); Yufei Hu, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 663 days.

(21) Appl. No.: 18/101,025

(22) Filed: Jan. 24, 2023

(65) Prior Publication Data

US 2024/0139900 A1 May 2, 2024

Related U.S. Application Data

(60) Provisional application No. 63/420,033, filed on Oct. 27, 2022.

(51) Int. Cl.
*B24B 37/005* (2012.01)
*B24B 37/04* (2012.01)

(52) U.S. Cl.
CPC ..... *B24B 37/005* (2013.01); *B24B 37/042* (2013.01)

(58) Field of Classification Search
CPC ..... B24B 37/013; B24B 37/005; B24B 37/30; B24B 37/10; B24B 37/105; B24B 37/04;
(Continued)

(56) References Cited

U.S. PATENT DOCUMENTS 5,240,552 A 8/1993 Yu et al.
5,904,609 A 5/1999 Fukuroda et al.
(Continued)

FOREIGN PATENT DOCUMENTS

CN 105345652 2/2016
CN 115008334 9/2022
(Continued)

OTHER PUBLICATIONS

International Search Report and Written Opinion in International Appln. No. PCT/US2023/063819, mailed on Jul. 18, 2023, 10 pages.
(Continued)

*Primary Examiner* — Joel D Crandall
(74) *Attorney, Agent, or Firm* — Fish & Richardson P.C.

(57) ABSTRACT

A chemical mechanical polishing apparatus has a platen to support a polishing pad, a carrier head comprising a rigid housing and configured to hold a surface of a substrate against the polishing pad, a motor to generate relative motion between the platen and the carrier head so as to polish the substrate, an in-situ carrier head monitoring system including a sensor positioned to interact with the housing and to detect vibrational motion of the housing and generate signals based on the detected vibrational motion, and a controller. The controller is configured to generate a value for a carrier head status parameter based on received signals from the in-situ carrier head monitoring system, and change a polishing parameter or generate an alert based on the carrier head status parameter.

19 Claims, 4 Drawing Sheets

(58) Field of Classification Search
CPC ..... B24B 37/042; B24B 49/10; B24B 49/16; B24B 49/04; B24B 49/12; B24B 49/003; B24B 49/02; B24B 7/228
See application file for complete search history.

(56) References Cited

U.S. PATENT DOCUMENTS

| | | | | |
|---|---|---|---|---|
| 6,488,569 | B1 | 12/2002 | Wang et al. | |
| 6,494,765 | B2 * | 12/2002 | Gitis | B24B 49/10 451/287 |
| 6,494,766 | B1 | 12/2002 | Wiswesser et al. | |
| 6,910,942 | B1 | 6/2005 | Dornfeld et al. | |
| 8,152,594 | B2 * | 4/2012 | Saito | B24B 49/18 451/287 |
| 9,254,545 | B2 | 2/2016 | Park | |
| 10,058,974 | B1 | 8/2018 | Chen et al. | |
| 2001/0010999 | A1 | 8/2001 | Numoto | |
| 2001/0051492 | A1 | 12/2001 | Donohue | |
| 2002/0124957 | A1 * | 9/2002 | Hofmann | B24B 49/16 156/345.12 |
| 2003/0049993 | A1 | 3/2003 | Fujii | |
| 2003/0109194 | A1 | 6/2003 | Wang et al. | |
| 2005/0181706 | A1 | 8/2005 | Berman et al. | |
| 2006/0183407 | A1 | 8/2006 | David | |
| 2007/0218806 | A1 | 9/2007 | Kistler | |
| 2008/0004743 | A1 | 1/2008 | Goers et al. | |
| 2014/0027407 | A1 | 1/2014 | Deshpande et al. | |
| 2014/0162534 | A1 * | 6/2014 | Lin | H01L 21/673 451/287 |
| 2014/0329439 | A1 | 11/2014 | Chew et al. | |
| 2015/0360343 | A1 * | 12/2015 | Yavelberg | B24B 37/32 438/5 |
| 2016/0256978 | A1 | 9/2016 | Tang et al. | |
| 2018/0071889 | A1 | 3/2018 | Huang et al. | |
| 2022/0281066 | A1 | 9/2022 | Li | |

FOREIGN PATENT DOCUMENTS

| | | | |
|---|---|---|---|
| JP | H09-150367 | A | 6/1997 |
| JP | 2001-244225 | A | 9/2001 |
| JP | 2001-334461 | A | 12/2001 |
| JP | 2003-236749 | | 8/2003 |
| JP | 2005-244258 | A | 9/2005 |
| JP | 5551479 | | 7/2014 |
| JP | 2015-188955 | | 11/2015 |
| JP | 2017-112316 | A | 6/2017 |
| JP | 2022-080370 | A | 5/2022 |
| KR | 10-0235208 | B1 | 4/2000 |
| KR | 10-2004-0083608 | | 10/2004 |
| KR | 10-2009-0024733 | A | 3/2009 |
| KR | 10-2013-0020513 | A | 2/2013 |
| KR | 10-2018-0118896 | | 11/2018 |
| KR | 10-2022-0100110 | A | 7/2022 |
| WO | WO 2018/052816 | A1 | 3/2018 |

OTHER PUBLICATIONS

Office Action in Chinese Appln. No. 202320738568.8, dated Jul. 10, 2023, 2 pages (with English summary).
Office Action in Taiwanese Appln. No. 112108453, dated Mar. 25, 2024, 13 pages (with English summary and search report).
Office Action in Japanese Appln. No. 2024-531261, mailed on May 27, 2025, 10 pages (with English translation).
Office Action in Korean Appln. No. 10-2024-7020948, mailed on Apr. 29, 2025, 13 pages (with English summary).
Extended European Search Report in European Appln. No. 23883516.9, mailed on Nov. 10, 2025, 8 pages.

* cited by examiner

ACOUSTIC CARRIER HEAD MONITORING

CROSS-REFERENCE TO RELATED APPLICATIONS

This application claims the benefit of priority to U.S. Provisional Application Ser. No. 63/420,033, filed on Oct. 27, 2022, the contents of which are hereby incorporated by reference.

FIELD OF THE DISCLOSURE

The disclosure relates to chemical mechanical polishing and more specifically, to determination of polishing parameters from signals received based on carrier head displacement during chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

The carrier head provides a controllable load on the substrate to push it against the polishing pad. Some carrier heads include a housing that attaches to a drive shaft and a gimbal mechanism which permits a base of the carrier head to gimbal relative to the housing and drive shaft while preventing lateral motion of the base.

SUMMARY

Disclosed herein is a chemical mechanical polishing apparatus including a carrier head to hold a substrate against a polishing pad. Relative motion is generated between the polishing pad and the carrier head which polishes the exposed face of the substrate. The apparatus includes an in-situ head monitoring system which receives vibration signals from the carrier head, e.g., from the housing, or from the gimbal. The head monitoring system generates signals from the carrier head which are transmitted to a controller. The controller receives the vibration signals and generates a carrier head status parameter based on the signals. The controller is configured to change one or more polishing parameter, or generate an alert, based on the carrier head status parameter.

In one aspect, a chemical mechanical polishing apparatus has a platen to support a polishing pad, a carrier head comprising a rigid housing and configured to hold a surface of a substrate against the polishing pad, a motor to generate relative motion between the platen and the carrier head so as to polish the substrate, an in-situ carrier head monitoring system including a sensor positioned to interact with the housing and to detect vibrational motion of the housing and generate signals based on the detected vibrational motion, and a controller. The controller is configured to generate a value for a carrier head status parameter based on received signals from the in-situ carrier head monitoring system, and change a polishing parameter or generate an alert based on the carrier head status parameter.

In another aspect, a method of polishing includes holding a substrate against a polishing surface of a polishing pad with a carrier head, generating relative motion between the substrate and polishing pad, monitoring a vibrational motion of the carrier head with an in-situ head monitoring system to generate a signal based on the motion, generate a value for a carrier head status parameter based on the signals from the in-situ carrier head monitoring system, and changing a polishing parameter or generating an alert based on the determined carrier head status parameter.

Implementations may optionally include one or more of the following advantages. A polishing rate can be determined, or a polishing rate determined by another monitoring system can be validated, thus improving reliability of endpoint control. Similarly, a value for a control parameter, e.g., rotation rate, pressure, etc., can be determined, or a control parameter value rate determined by technique can be validated, thus improving reliability of system control. Impending system faults can be detected, permitting corrective action in advance of the fault actually occurring.

The details of one or more embodiments are set forth in the accompanying drawings and the description below. Other features and advantages will be apparent from the description and drawings, and from the claims.

DESCRIPTION OF DRAWINGS

FIGS. 2-4A are diagrams of a carrier head having a head monitoring system.

In the figures, like references indicate like elements.

DETAILED DESCRIPTION

Figure 1:
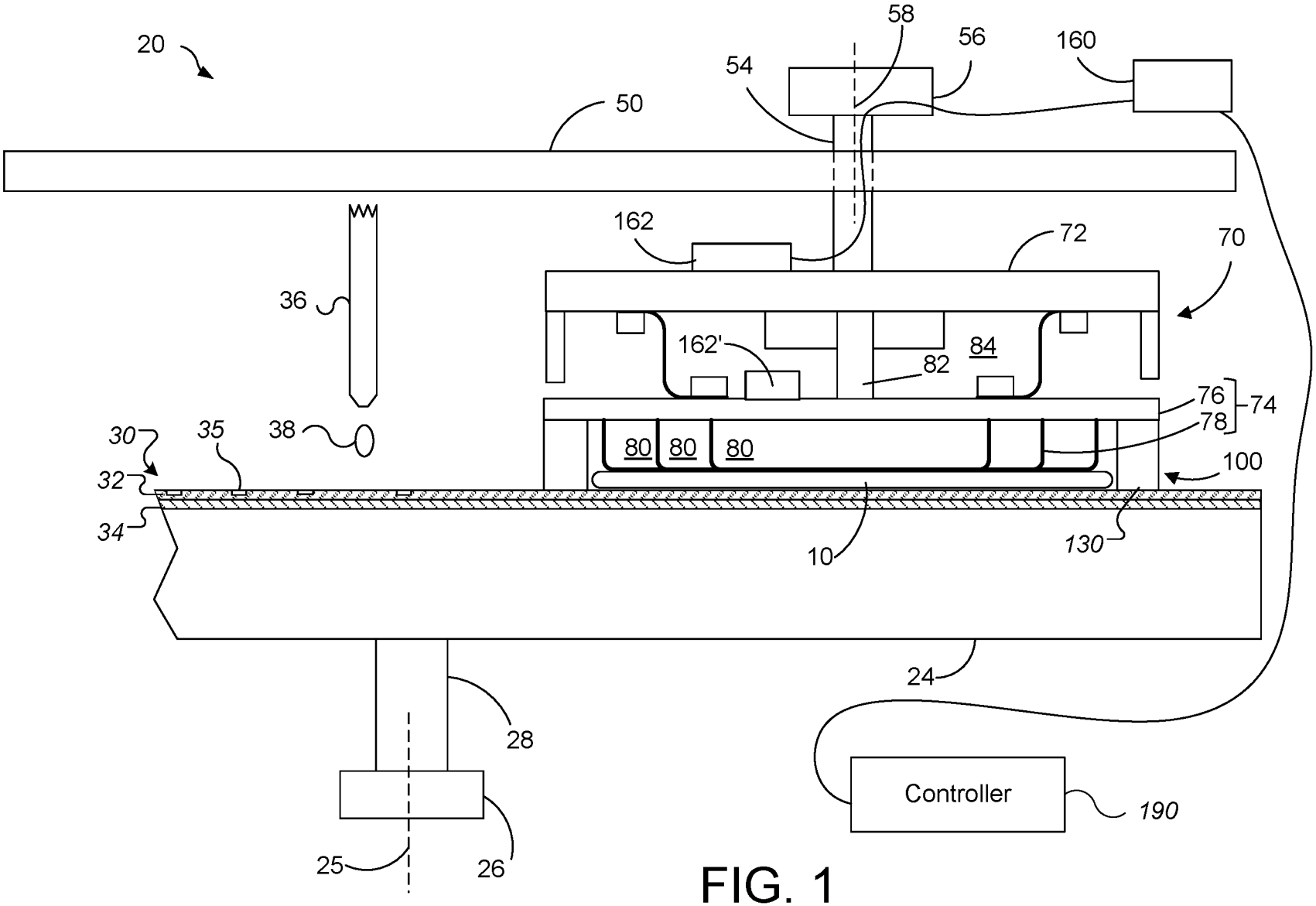
FIG. 1 is a system diagram of a polishing system including an in-situ acoustic monitoring system.

During a polishing process the carrier head moves in a path as the retaining ring and substrate interact with the polishing layer of the polishing pad. Polishing outcomes (e.g., layer thicknesses, or layer uniformity) can vary based on at least the frictional contact between the surfaces and various other polishing parameters such as zone pressures, platen speed, head type, or conditioning recipe.

A variety of issues can arise in chemical mechanical polishing. The techniques described herein can address any one, or more than one, of these problems, independently or in conjunction.

One problem in CMP is determining the polishing rate of the layer being polished. A variety of techniques, e.g., optical or eddy current monitoring can be used. In general, these monitoring techniques generate a value representative of the thickness. A polishing rate can be calculated by monitoring a sequence of thickness measurements over time and determining the slope of a line fit to the measurements. However, these techniques are slow to detect changes in polishing rate as sufficient data needs to be accumulated, and require moderately complex monitoring system.

However, if vibrational signals are correlated to polishing rates, then a polishing rate determined from the vibrational signal can serve as a validation for another monitoring system, or can render other monitoring techniques, e.g., eddy current or optical, unnecessary.

Another problem in CMP is verification that the polishing system is operating with the desired control parameters, e.g., desired rotation rates or chamber pressures. Ideally the appropriate physical components, e.g., motors or pressure regulators, are simply caused by a controller to operate according to a recipe with the desired control parameter values. However, in practice the actual values, e.g., actual rotation rates or chamber pressures, can vary from the desired values due to transient effects or system faults.

However, if vibration signals are correlated to a control parameter, e.g., chamber pressure or rotation rate, then a control parameter value determined from the vibrational signal can serve as a validation or fault detection for another control parameter sensor, e.g., a pressure sensor or motor encoder, or can render the other sensors unnecessary.

Yet another problem in CMP is determining "system health." A failure during polishing, e.g., wafer slippage from the carrier head, failure to chuck or dechuck the substrate, stiction between membranes in the carrier head, etc., can result in direct damage to the substrate being polished and require extensive down-time for system maintenance. Conventionally, such failures are detected only after they occur. For example, visual inspection or a camera might detect that the substrate has slipped from beneath the carrier, or a change in polishing rate may indicate a fault.

However, if vibration signals are correlated to an impending fault condition, it would be possible to diagnose problems so that corrective action can be taken before the failure occurs.

Still another problem in CMP is detecting the polishing endpoint. As noted above, a variety of techniques, e.g., optical, eddy current, motor current, have been used to detect a layer thickness or detect exposure of an underlying layer. However, such techniques require can require complex sensor systems, and some approaches are not reliable in some applications.

However, if vibration signals, particularly strain on the gimbal in the carrier head, are correlated to a polishing endpoint condition, then a polishing endpoint determined from the vibrational signal can serve as a validation for another monitoring system, or can render other monitoring techniques, e.g., eddy current or optical, unnecessary.

The techniques described herein can address any one, or more than one, of these problems, independently or in conjunction.

In general, by placing a vibration or displacement sensor on or adjacent the carrier head and analyzing the signal from the sensor, one or more of the above problems may be addressed. The approach can also be used for other purposes. For example, this signal can be used to correct errors in one or more polishing parameters. Detection of such errors increases WIW and WTW uniformity.

FIG. 1 illustrates an example of a polishing station of a chemical mechanical polishing system 20. The polishing system 20 includes a rotatable disk-shaped platen 24 on which a polishing pad 30 is situated. The platen 24 is operable to rotate about an axis 25. For example, a motor 26 can turn a drive shaft 28 to rotate the platen 24. The polishing pad 30 can be a two-layer polishing pad with an outer polishing layer 32 and a softer backing layer 34. Grooves 35 can be formed in the polishing surface of the polishing layer 32.

The polishing system 20 can include a supply port or a combined supply-rinse arm 36 to dispense a polishing liquid 38, such as an abrasive slurry, onto the polishing pad 30. The polishing system 20 can include a pad conditioner apparatus with a conditioning disk to maintain the surface roughness of the polishing pad 30. The conditioning disk can be positioned at the end of an arm that can swing so as to sweep the disk radially across the polishing pad 30.

A carrier head 70 is operable to hold a substrate 10 against the polishing pad 30. The carrier head 70 is suspended from a support structure 50, e.g., a carousel or a track, and is connected by a drive shaft 54 to a carrier head rotation motor 56 so that the carrier head 70 can rotate about an axis 58. Optionally, the carrier head 70 can oscillate laterally, e.g., on sliders on the carousel, by movement along the track, or by rotational oscillation of the carousel itself.

The carrier head 70 includes a housing 72 that can be secured to the drive shaft 54, a substrate backing assembly 74 which includes a base 76 and a flexible membrane 78 that defines a plurality of pressurizable chambers 80, a gimbal mechanism 82 (which may be considered part of the assembly 74), a loading chamber 84, and a retaining ring 100. The lower surface of the flexible membrane 78 provides a mounting surface for a substrate 10.

The housing 72 can generally be circular in shape and can be connected to the drive shaft 54 to rotate therewith during polishing. There may be passages (not illustrated) extending through the housing 72 for pneumatic control of the carrier head 70. The substrate backing assembly 74 is a vertically movable assembly located beneath the housing 72.

Assuming a gimbal mechanism 82 is present, the gimbal mechanism permits the base 76 to gimbal, e.g., angularly deflect, relative to the housing 72 and drive shaft 54, while preventing lateral motion of the base 76 relative to the housing 72. For example, if the substrate backing assembly 74 defines a first plane, and the housing 72 a second plane, the gimbal mechanism 82 facilitates angular deflections between the plane of the housing 72 and the plane of the substrate backing assembly 74 such that they are no longer parallel or coplanar.

The gimbal mechanism can be provided by a bendable flexure, or by a ball-in-socket type joint. The bendable flexure can permits the entire substrate backing assembly 74 to move vertically relative to where the gimbal mechanism 82 contacts the housing 72, whereas the ball-in-socket type joint holds the substrate backing assembly 74 vertically fixed relative to where the gimbal mechanism 82 contacts the housing 72. In some implementations, the gimbal of the gimbal mechanism is attached to a bottom of a shaft which is itself vertically slidable in a passage in the housing 72. In some implementations, the gimbal mechanism is fixed to the housing and not vertically movable.

The loading chamber 84 is located between the housing 72 and the base 76. The loading chamber 84 is pressurizable, e.g., increased atmospheric pressure within the loading chamber 84, to apply a load, i.e., a downward pressure or weight, to the base 76 and thus to the substrate backing assembly 74. The vertical position of the substrate backing assembly 74 relative to the polishing pad 30 is also controllable by the loading chamber 84. In some implementations, the substrate backing assembly 74 is not a separate component that is movable relative to the housing 72. In this case, the chamber 84 and gimbal 82 are unnecessary.

The polishing system 20 includes at least one in-situ head monitoring system 160. The in-situ head monitoring system 160 includes one or more motion sensors 162 arranged on, i.e., contacting, or having a view of the carrier head 70. In particular, the in-situ head monitoring system 160 can be configured to measure motion of the carrier head and detect a variety of conditions, e.g., vibrational emissions caused by errors in the head position, head gimbaling, or polishing parameters.

An example of the motion sensor 162 is a direct contact sensor which detects motion of surfaces in contact with the motion sensor 162. A direct contact motion sensor 162 is mounted with fixtures or adhesives to the carrier head 70. In particular, one or more motion sensors 162, e.g., motion sensor 162 and motion sensor 162', can be mounted to a relatively rigid component of the carrier head, e.g., a portion of the housing 72 or the base 76 ("relatively rigid" is in comparison to the flexible membrane 78). The motion sensor 162 can be, for example, an accelerometer or velocity sensor.

In the example of FIG. 1, the motion sensor 162 is mounted to the top surface of the housing 72 of the carrier head 70. In examples using an adhesive layer, the adhesive layer increases the contact area between the motion sensor 162 and the relatively rigid component, e.g., the housing 72, and reduces undesirable motion in the motion sensor 162 during polishing operations, e.g., increases coupling of the motion between the relatively rigid component and the motion signal sensors 162. However, in some implementations, the motion sensor 162 contacts the housing 72 directly and can be detachably secured with mechanical fasteners such as screws or bolts.

In general, the carrier head 70 and platen 24 rotate during the polishing process at a rate in a range from 50 to 150 RPM. The motion sensor 162 monitors high frequency motion, e.g., vibration, at a higher frequency than the carrier head 70 rotates. In some examples, the frequency range of the vibrations monitored by the motion sensor 162 can be in a 1 kHz to 100 kHz range, e.g., 2 kHz to 40 kHz, or 5 kHz to 80 kHz.

The motion sensor 162 generates an electronic signal indicative of the vibration of the housing 72. The head monitoring system 160 receives the electronic signal from the motion sensor 162 and communicates the electronic signal to the controller 190. The controller 190 processes the received electronic signal to determine one or more carrier head status value of the carrier head 70.

In some implementations, the carrier head monitoring system 160 performs signal processing on the vibration data generated by the motion sensor 162 to filter, or de-noise, the vibration data before communicating the vibration data to the controller 190. In some examples, the head monitoring system 160 applies a smoothing process, a binning process, an average process, or a de-noising process. In some implementations, the head monitoring system 160 determines alternative data parameters, such as a derivative, an average, an integral, a standard deviation, or a variance of the vibration signal. In some implementations, the controller 190 receives the vibration signal from the head monitoring system 160 and performs the data processing.

The controller 190 can be configured to generate a value for a carrier head status parameter based on the received electronic signal. More specifically, the electronic signal can be correlated with an actual value of a carrier head status parameter such as a chamber pressure. For example, increasing a pressure in a chamber may cause a frequency response in the vibration signal. By correlating the frequency response with the chamber pressure, the chamber pressure can be effectively measured. For example, the controller can store a function that depends on power or intensity in one or more bandwidths in the acoustic frequency spectrum, or that depends on a frequency of a peak (including local minima and maxima) in the acoustic frequency spectrum, and outputs the value of the carrier head status parameter, e.g., a chamber pressure. Consequently, the vibration signal can provide an indirect determination of the chamber pressure without using a direct measurement device, e.g., using a pressure gauge. The controller 190 can then compare the value with a threshold to determine an alert. Examples of a carrier head status parameter include a pressure in one or more pressurizable chambers 80, a gimbal position of the gimbal mechanism 82, or an amount of gimbaling of the carrier head 70.

The controller 190 can be configured to compare values of the electronic signal to one or more carrier head status threshold values, e.g., a threshold value for each of the carrier head status parameters, to generate an alert in a validation or fault-detection mode. The alert can be indicative of whether the polishing system 20 is functioning properly or improperly, e.g., according to, or not according to, programed guidelines. In such implementations, the controller 190 generates an alert responsive to the value of electronic signal exceeding the stored threshold value. Examples of the alert can include an audio, or visual alert displayed on a user device. Additional or alternative examples of the alert can include a notification transmitted to a networked device connected to the polishing system 20.

For example, the controller 190 receives the electronic signal which includes an amplitude value corresponding to the vibrational signal. The controller 190 compares the amplitude value to a respective maximum carrier head status threshold value. The controller 190 can be configured to determine if the generated carrier head status value exceeds a threshold status value stored in the controller 190. In this example, if the carrier head 70 is undergoing a fault, or failure condition, or may undergo an impending failure condition in a short time, the amplitude value of the vibration signal may exceed the corresponding threshold value stored in the controller 190.

The controller 190 can store an array of failure modes which can be correlated with one or more electronic signal values corresponding to portions of the vibrational signal. In the previous example, the amplitude value of the vibrational signal exceeding the corresponding threshold value can be associated with a substrate slippage failure, or a retaining ring failure.

In additional or alternative to the failure mode detection, the controller 190 can be configured to change an operational value of the polishing system 20 responsive to the carrier head status value exceeding the corresponding threshold status value. The controller 190 determines the amplitude of the vibration signal from the electronic signal and compares the amplitude to a carrier head status threshold value. The amplitude exceeding the corresponding carrier head status threshold value can be indicative of an improper amount of gimbaling of the carrier head 70. The controller 190 may change a gimbaling value of the gimbal mechanism 82, responsive to the determination.

Figure 2:
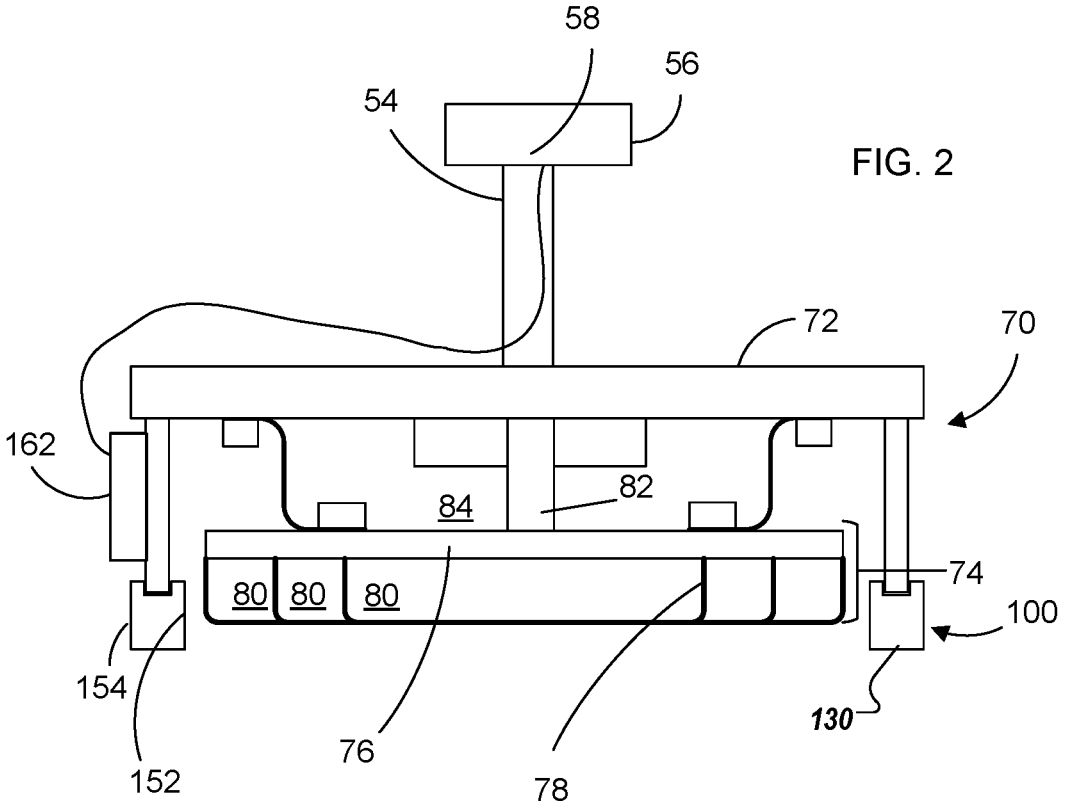

The motion sensor 162 can be mounted to alternative locations of the carrier head 70. The motion sensor 162 is mounted (e.g., with reversible fasteners, or adhesive) to a side surface of the carrier head 70 in FIG. 2. Mounting the motion sensor 162 to a side surface provides increased sensitivity to motion due to the increased distance from the axis 58 of the carrier head 70.

Figure 3:
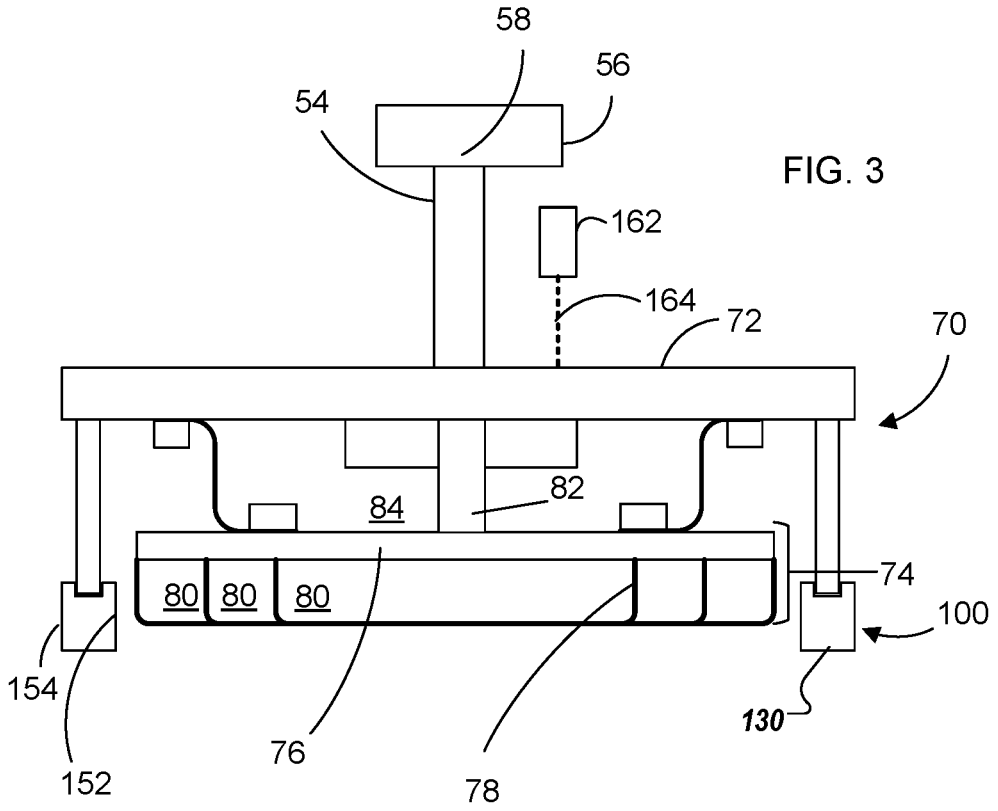

In some instances, a non-contact head monitoring system is desirable. A further example of the motion sensor 162 is an indirect (non-contact) sensor. The motion sensor 162 in FIG. 3 is an optical displacement sensor having a line of sight to the upper surface of the carrier head 70. For example, the motion sensor 162 can generate a light beam 164 which reflects from the upper surface. The motion sensor 162 receives the reflected light and generates an electronic signal indicative of the vibration signal of the carrier head 70 based on the reflected light. Such implementations facilitate increased monitoring frequency of the vibration signal as optical displacement sensors can have data frequency rates substantially above the rotation rate of the carrier head 70. In addition, such implementations can reduce effects on carrier head dynamics as compared to a contact sensor, e.g., less likelihood of a weight imbalance which could improper undesired vibration and faults. In general, the carrier head 70 is composed of rigid materials (e.g., high stiffness) and as such the vibration signal measurement accuracy can be within micron accuracy, e.g., an accuracy of less than 50 um, less than 10 um, or less than 5 um (e.g., 1 um). In some examples, the light source of the non-contact motion sensor 162 is freestanding in the polishing station and reflects off the head.

Figure 4A:
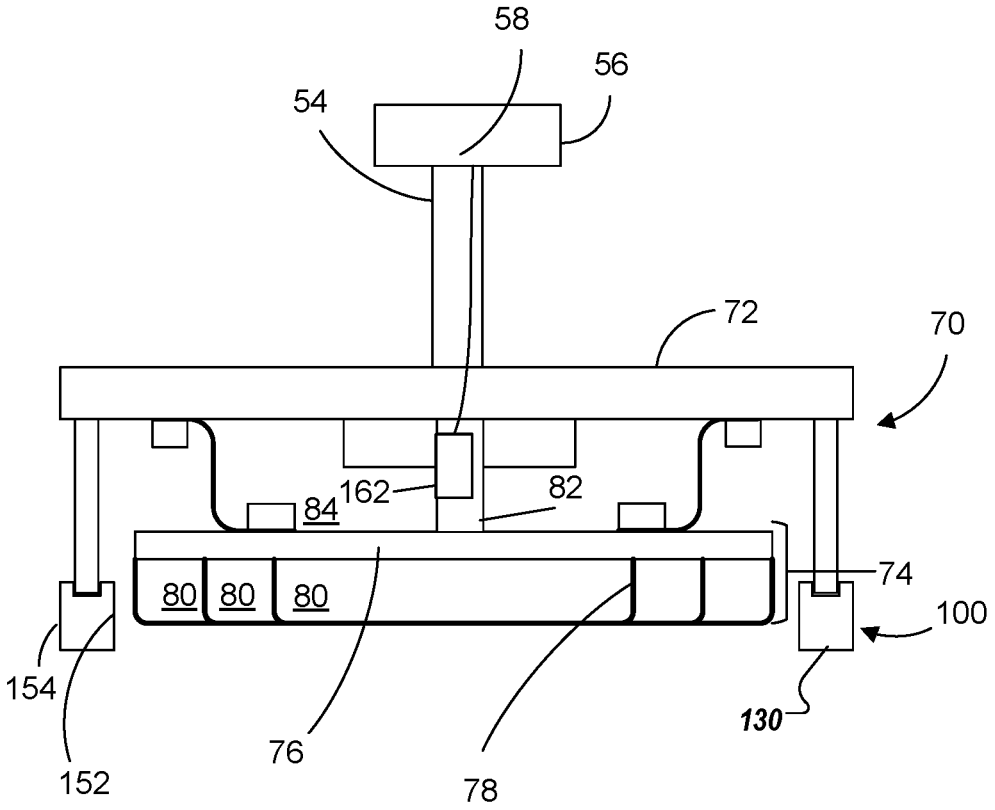

In some implementations, motion signals of the gimbal mechanism 82 are desirable to monitor. In FIG. 4A, the motion sensor 162 is a strain gauge and is mounted to the gimbal mechanism 82. The strain gauge motion sensor 162 is an example of a direct contact sensor which monitors angular deflections or deformations of the surface on which is it mounted, e.g., the gimbal mechanism 82.

Figure 4B:
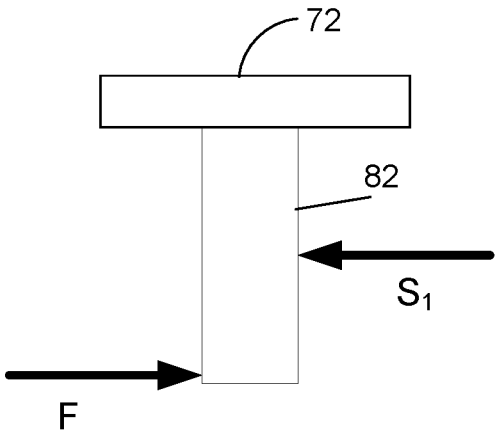
FIGS. 4B and 4C are schematic diagrams of strain forces on a gimbal mechanism.
Figure 4C:
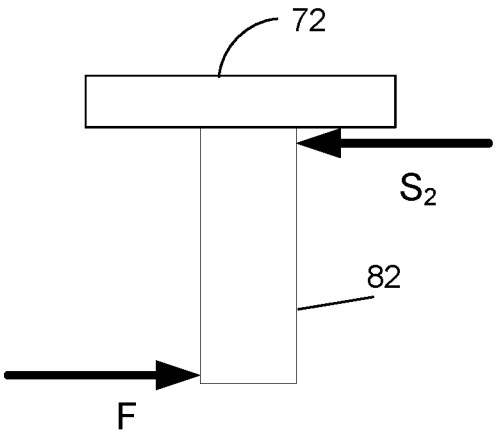

The motion sensor 162 is mounted to the gimbal mechanism 82 to monitor the area of highest strain on the gimbal mechanism 82. Such implementations facilitate increased precision and accuracy of gimbaling of the carrier head 70. FIGS. 4B and 4C illustrate the gimbal mechanism 82 and the housing 72 in an example in which the gimbal mechanism 82 is a flexible gimbal mechanism 82 (FIG. 4B), and an example in which the gimbal mechanism 82 is a constant height gimbal mechanism 82 (FIG. 4C). The lateral shear force applied to the gimbal mechanism 82 due to the friction between the substrate 10 and the polishing layer 32 during polishing is shown as arrow F. The area of highest strain is approximated in FIG. 4B as arrow $S_1$ while the area of highest strain is approximated in FIG. 4C as arrow $S_2$.

Figure 5:
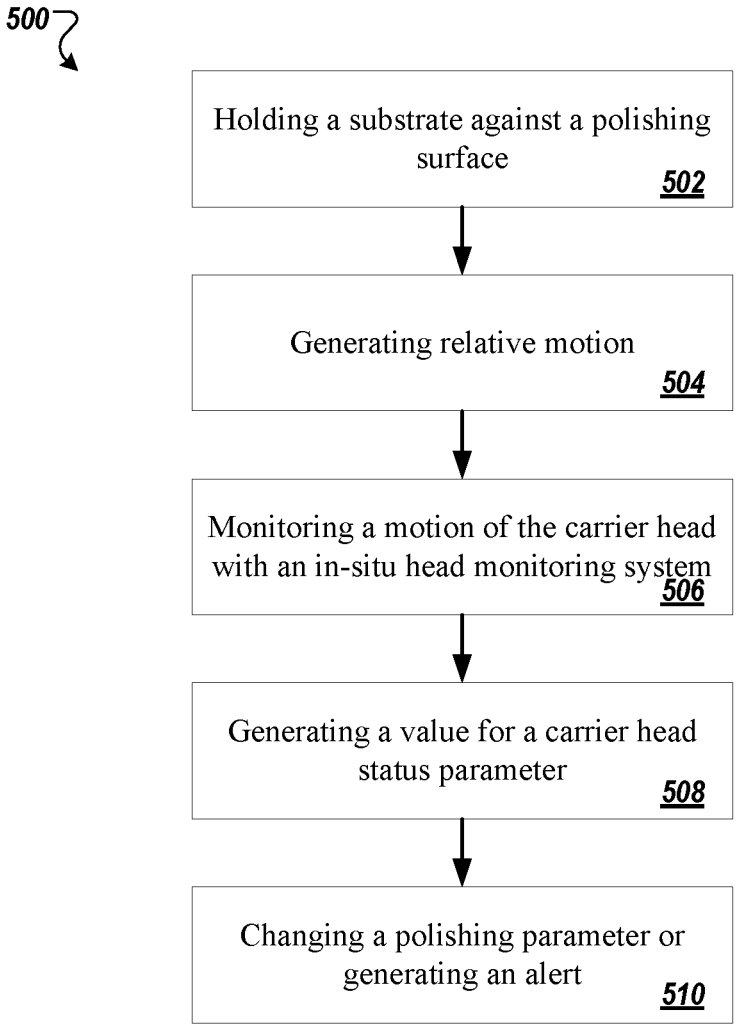
FIG. 5 is a flow chart diagram of an example method of a polishing process.

FIG. 5 is a flow chart diagram depicting a method of polishing 500 to change a polishing parameter or generate an alert responsive to detected signals from the head monitoring system 160.

The method includes holding the substrate 10 against the polishing layer 32 (step 502). The substrate 10 is held against the polishing layer 32 by pressurizable chambers 80 of the carrier head 70. The gas pressure within the pressurizable chambers 80 is controlled by the controller 190 such that the substrate 10 is pressed against the polishing layer 32. The substrate 10 is retained beneath the carrier head 70 by a ring assembly 100 which contacts the polishing layer 32 during the polishing operation.

The method includes generating relative motion between the substrate 10 and the polishing layer 32 (step 504). The polishing system 20 generates at least a portion of the relative motion by operating the motor 26 to cause the platen 24 to rotate about an axis 25. Rotation of the platen 24 causes rotation of the pad 30 and generates relative motion between the substrate 10 and the polishing layer 32. Additionally or alternatively, the polishing system 20 generates a portion of the relative motion by operating the carrier head rotation motor 56 to cause the carrier head 70 to rotate. In some implementations, the polishing system 20 includes a linear actuator to cause motion of the drive shaft 54 along the support structure 50 which generates a portion of the relative motion between the substrate 10 and the polishing layer 32.

The method includes monitoring the carrier head 70 with an in-situ head monitoring system 160 (step 506). Motion of the platen 24, carrier head 70, and/or substrate 10 causes friction between contacting components which induces a portion of the vibrations in the housing 72 or gimbal mechanism 82. A motion sensor 162 monitors the motion of one or more of the housing 72, carrier head 70, or gimbal mechanism 82 and receives data corresponding to the motion. The motion sensor 162 can be a contact, or non-contact, sensor 162, such as any example described herein. The motion data is received by the head monitoring system 160. The head monitoring system 160 generates a vibration signal indicative of the motion. The vibration signal is communicated to the controller 190.

The method includes generating a value for a carrier head status parameter (step 508). The controller 190 receives the vibration signal and determines whether a parameter of the vibration signal exceeds a vibration threshold stored in a storage device of the chemical mechanical polishing system 20, e.g., in the controller 190. The controller 190 determines that the parameter exceeding the associated threshold corresponds with, e.g., indicates, a problem with the polishing process. For example, the problem with the polishing process is a bubble caught between the ring assembly 100, or the substrate 10, and the polishing layer 32 of the pad 30. As an alternative or additional example, the problem with the polishing process is a gimbaling value, e.g., an angular deflection, of the gimbal mechanism 82.

The controller 190 generates a value for the carrier head status parameter based on the parameter of the vibration signal exceeding a threshold. The carrier head status parameter can be a speed, a rotation angle, a pressure, or a gimbaling. The controller 190 compares the determined value to a carrier head status parameter threshold.

The method includes changing a polishing parameter, generating an alert, or both, based on the vibration signal (step 510). Responsive to the determined value exceeding the carrier head status parameter threshold, the controller 190 orders the chemical mechanical polishing system 20 to alter a polishing parameter, generates an alert, or both. For example, the controller 190 orders the carrier head 70 to reduce a pressure in the loading chamber 84, in the pressurizable chambers 80, or both, based on a carrier head pressure value exceeding the pressure threshold. In a further example, the controller 190 generates an alert based on a gimbaling value exceeding a gimbaling threshold, which can include terminating the polishing process.

In some implementations, the controller 190 determines a polishing parameter corresponding to the associated problem. For example, in instances in which a bubble is between the ring assembly 100 and the polishing layer 32, the controller 190 determines that a pressure value of the carrier head 70 against the polishing layer 32 is to be reduced sufficiently that the bubble exits the space between the ring assembly 100 and the polishing layer 32.

For example, if the controller 190 determines a strain parameter of the vibration signal exceeds a strain threshold, the controller 190 determines that an error in the gimbal position of the gimbal mechanism 82 exists. In response to the determination of one or more errors, or parameter exceeding a threshold, the controller 190 orders one or more chamber pressures of the pressurizable chambers 80 be reduced so that side load on the retaining ring 100, and thus on the gimbal mechanism 82, is reduced thereby altering the position of the flexible gimbal mechanism 82. In additional or alternative examples, the controller 190 generates an alert based on the determined difference, which can include a visual, audio, textual, or command alert communicated to a user device, a networked device, or a component of the polishing system 20.

Implementations of the subject matter and the functional operations described above can be implemented in digital electronic circuitry, or in computer software, firmware, or hardware, including the structures disclosed in this specification and their structural equivalents, or in combinations of one or more of them. Implementations of the subject matter described in this specification, such as storing, maintaining, and displaying artifacts can be implemented as one or more computer program products, i.e., one or more modules of computer program instructions encoded on a tangible program carrier, for example a computer-readable medium, for execution by, or to control the operation of, a processing system. The computer readable medium can be a machine readable storage device, a machine readable storage substrate, a memory device, or a combination of one or more of them.

The term "system" may encompass all apparatus, devices, and machines for processing data, including by way of example a programmable processor, a computer, or multiple processors or computers. A processing system can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, executable logic, or code) can be written in any form of programming language, including compiled or interpreted languages, or declarative or procedural languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Computer readable media suitable for storing computer program instructions and data include all forms of non-volatile or volatile memory, media and memory devices, including by way of example semiconductor memory devices, e.g., EPROM, EEPROM, and flash memory devices; magnetic disks, e.g., internal hard disks or removable disks or magnetic tapes; magneto optical disks; and CD-ROM, DVD-ROM, and Blu-Ray disks. The processor and the memory can be supplemented by, or incorporated in, special purpose logic circuitry. Sometimes a server is a general purpose computer, and sometimes it is a custom-tailored special purpose electronic device, and sometimes it is a combination of these things. Implementations can include a back end component, e.g., a data server, or a middleware component, e.g., an application server, or a front end component, e.g., a client computer having a graphical user interface or a Web browser through which a user can interact with an implementation of the subject matter described is this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable subcombination.

What is claimed is:

1. A chemical mechanical polishing apparatus, comprising:

a platen to support a polishing pad;

a carrier head comprising a rigid housing, the carrier head configured to hold a surface of a substrate against the polishing pad;

a motor to generate relative motion between the platen and the carrier head so as to polish the substrate;

an in-situ carrier head monitoring system including a sensor positioned to interact with the housing and to detect vibrational motion of the housing and generate signals based on the detected vibrational motion; and a controller configured to generate a value for a carrier head status parameter based on received signals from the in-situ carrier head monitoring system, wherein the carrier head status parameter indicates an impending fault prior to the fault occurring, and change a polishing parameter or generate an alert based on the carrier head status parameter.

2. The apparatus of claim 1, wherein the sensor of the in-situ carrier head monitoring system is mounted to an outer surface of the housing.

3. The apparatus of claim 2, wherein the sensor is mounted to a top surface of the housing.

4. The apparatus of claim 2, wherein the sensor comprises an accelerometer.

5. The apparatus of claim 1, wherein the sensor of the in-situ carrier head monitoring system is spaced from and configured to direct electromagnetic energy to an outer surface of the housing.

6. The apparatus of claim 5, wherein the sensor comprises a displacement sensor.

7. The apparatus of claim 6, wherein the displacement sensor is configured to monitor vertical displacement of the housing.

8. The apparatus of claim 6, wherein the displacement sensor is an optical displacement sensor.

9. The apparatus of claim 8, wherein the optical displacement sensor is configured to generate measurements at a frequency in a range from 1 kHz to 100 kHz and to measure displacements in the carrier head at a resolution of less than 1 μm.

10. The apparatus of claim 8, wherein the sensor comprises a laser interferometer.

11. The apparatus of claim 1, wherein the carrier head comprises a gimbal mechanism, and the in-situ carrier head monitoring system comprises a strain sensor mounted to the gimbal mechanism, and the detected vibrational motion is a detected angular deflection of the housing from a rotational axis of the gimbal mechanism.

12. The apparatus of claim 11, wherein the gimbal mechanism is a flexible gimbal mechanism or a ball-in-socket gimbal mechanism.

13. The apparatus of claim 1, wherein the controller is further configured to determine a polishing endpoint based on the carrier head status parameter.

14. The apparatus of claim 1, wherein the carrier head status parameter comprises a carrier head displacement, a shear force, a carrier head rotation speed, or a carrier head type.

15. The apparatus of claim 1, wherein the vibrational motion occurs at a frequency above a frequency threshold.

16. A method of polishing, comprising:

holding a substrate against a polishing surface of a polishing pad with a carrier head;

generating relative motion between the substrate and polishing pad;

monitoring a vibrational motion of the carrier head with an in-situ carrier head monitoring system to generate a signal based on the motion;

generate a value for a carrier head status parameter based on the signals from the in-situ carrier head monitoring system, wherein the carrier head status parameter indicates an impending fault prior to the fault occurring; and changing a polishing parameter or generating an alert based on the value generated for the carrier head status parameter.

17. The method of claim 16, wherein monitoring the carrier head comprises monitoring an angular deflection of the carrier head with respect to an axis of rotation of the carrier head, and the signal is a strain signal.

18. The method of claim 16, wherein monitoring the carrier head comprises monitoring a vertical displacement of the carrier head with respect to the in-situ head monitoring system, and the signal is an optical signal.

19. The method of claim 16, wherein monitoring the carrier head comprises monitoring a vibration of the carrier head, and the signal is an acceleration signal.

* * * * *